US005513851A

United States Patent [19]

Harris

[11] Patent Number: 5,513,851

[45] Date of Patent: May 7, 1996

[54] CASINO DICE TABLE GAME

[76] Inventor: Stephen M. Harris, 3409 Colony Square West, St. Joseph, Mo. 64506

[21] Appl. No.: 420,130

[22] Filed: Apr. 11, 1995

[51] Int. Cl.[6] ..... A63F 9/04

[52] U.S. Cl. ..... 273/274

[58] Field of Search ..... 273/274, 146, 273/292

[56] References Cited

U.S. PATENT DOCUMENTS

| | | | |
|---|---|---|---|
| 4,247,114 | 1/1981 | Carroll | 273/274 |
| 4,334,685 | 6/1982 | Robbins et al. | 273/274 |
| 4,466,615 | 8/1984 | Yaeger | 273/292 |
| 5,046,737 | 9/1991 | Fienberg | 273/139 |
| 5,133,559 | 7/1992 | Page | 273/274 |
| 5,188,364 | 2/1993 | Falzarano | 273/126 R |
| 5,265,881 | 11/1993 | Doherty | 273/274 |
| 5,308,081 | 5/1994 | Bartle | 273/274 |
| 5,350,175 | 9/1994 | DiLullo et al. | 273/146 |
| 5,364,104 | 11/1994 | Jones et al. | 273/292 |
| 5,413,351 | 5/1995 | Franklin | 273/274 |

*Primary Examiner*—Benjamin H. Layno
*Attorney, Agent, or Firm*—Kokjer, Kircher, Bowman & Johnson

[57] ABSTRACT

A gaming apparatus and method are provided which relate to a dice table game having at least two levels of wagering in cooperation with an optional jackpot wager. During operation, a player places an optional jackpot wager and a first level wager upon one of the possible dice combinations. If the player loses at the first level, both wagers are taken by the house. If the player wins at the first level, the player's jackpot wager remains and the player is paid for the first level wager based upon the odds associated with the selected dice combination. When the player wins at the first level, the player is required to place a wager upon a second level by selecting one of the possible combinations of dice offered at the second level. If the player loses at the second level, the second level wager and the jackpot wager are taken by the house. When the player wins at the second level, a payout is effected based upon the odds associated with the dice combination selected by the player and the jackpot wager is held. After a win at the second level, the player is again required to place a wager at a third level. The third level corresponds to a single dice combination, such as "2". If the third level dice combination is rolled, the player is paid according to a third level payout. In addition, if the player made the appropriate jackpot wager prior to wagering at the first level, the player is also paid from a jackpot.

16 Claims, 1 Drawing Sheet

CASINO DICE TABLE GAME

BACKGROUND OF THE INVENTION

1. Field of the Invention

The invention generally relates to a game for use in wagering establishments such as casinos and the like. More particularly, the invention relates to a dice game having multiple levels through which, as players progress, players are afforded the opportunity to place wagers with higher payouts and which provides an optional jackpot side bet.

2. Description of the Related Art

Many gaming systems and methods have been proposed, but have met with limited success.

The patent to Jones (U.S. Pat. No. 5,364,104) discloses an apparatus for playing a progressive jackpot game wherein a user plays a card game such as 21, at the beginning of which the player places his usual wager for the play of the 21 hand. In addition, the player places an additional wager to be eligible to participate in a progressive jackpot. If the player's 21 hand wins and the player has made the necessary additional wager to play for the progressive jackpot, a percentage of the winnings within the jackpot is paid to the winner depending upon the winner's hand. When a player achieves a winning hand, the jackpot is manually activated by pushing a button that corresponds to the type of hand that the player has achieved. The amount won by the player is electronically deducted from the jackpot progressive total.

The patent to Bartle (U.S. Pat. No. 5,308,081) discloses a method of playing a three dice betting game, in which the playing surface has three types of betting zones demarcated upon it. The first zone corresponds to a singles betting zone in which the player places a bet upon one of the six numerals of a dice before the first throw. Players who bet on the resulting dice number are winners. Two types of second betting zones are included, a doubles betting zone and a seconds betting zone. A player betting upon the doubles betting zone is betting upon two dice having the same value. A player betting on the seconds betting zone is regarded as a winner if the result of the second dice is the same as obtained by the throw of the first dice or if the result upon the second dice equals a three.

Bartle discloses eight different types of third betting zones. The first of the third type of betting zone includes the numerals 3–18 therein. A player bets on any of these numerals before the first, second, or third dice are thrown. The next third type of betting zone 20 represents a low range of totals betting zone which includes a 3–10 representation therein. A player must place a bet on the low range zone before the first dice is thrown. If the cumulative total of the three dice is between 3 and 10, a player wins. The third type represents a high range betting zone and is utilized in a manner similar to the low range betting zone, except that the winning range corresponds to the cumulative dice values 11–18. Next, a non-specific triples betting zone is utilized, at which the player is regarded a winner when all three dice display the same number. The player bets on the non-specific triples betting zone before any of the three dice are thrown. A specific triple combination betting zone is also provided wherein the player bets upon a specific triples combination. A player is also allowed to bet on a combination of odds and evens to bet upon whether the next dice thrown will correspond to an odd or even value. A player may bet on the odds and evens betting zone between each throw of the dice.

The patent to DiLullo et al. (U.S. Pat. No. 5,350,175) discloses a dice betting game having numerical zones that represent the possible outcomes of the sum of either two or three rolls of the dice. Certain zones are provided with payout rewards of different odds, while other zones are defined as "walls", which correspond to losing dice combinations. If the sum of the rolls of the dice fall within a wall, the bets are collected by the house and all players lose. When the dice corresponds to a combination other than one within a wall, a payout is effected to the player who bet upon the winning combination of dice.

To play DiLullo's game, players place bets in the survival bet zone. One player rolls the dice to produce an outcome N1. If the outcome N1 corresponds to a number within the wall, all players lose. If the outcome N1 does not fall within the wall, the shooter rolls again to obtain a second outcome N2. If the sum of the first and second outcomes N1+N2 falls within the wall, all betters lose. Otherwise, all players within the survival bet zone are paid a reward equaling the odds proximate the numerical zone corresponding to the sum of the outcomes N1+N2. In a second embodiment, the foregoing system is implemented with three rolls, instead of two rolls.

The patent to Carroll (U.S. Pat. No. 4,247,114) discloses a board game which utilizes red, white, and green dice. The player is allowed to bet on odd or even values for the red and green dice. If the red and green dice show doubles, any player playing the proper number in the doubles betting area will win. In order for a player to win both of the colored numbers, first the numbers bet upon by the player must show upon the respective red and green dice. In addition, either the red or green dice must combine with the white dice to equal 7 to complete the game. This process is repeated after each throw of the dice.

The patent to Robbins et al. (U.S. Pat. No. 4,334,685) discloses a three dice wagering game which allows a better the ability to bet upon different combinations and permutations of three dice (two white dice and one red dice).

The patent to Page (U.S. Pat. No. 5,133,559) discloses a casino dice game which utilizes two sets of dice (one large set and one small set), each of which includes a red, white, and green dice. To play, a player places a bet on any desired betting area A–L. Next, all six dice are rolled and players are rewarded based on attained bets. Various combinations of the dice are used to judge wins depending upon which of the betting areas the player has bet upon.

The foregoing systems have met with limited success as they are not sufficiently challenging or do not offer a high enough payout. If a large payout is offered, the odds of winning are overly small and deter playing.

A need remains within the industry for an improved casino game. The present invention is intended to meet this need.

SUMMARY OF THE INVENTION

It is an object of the present invention to provide a dice game which combines a side bet possibility for a jackpot payout with a progressive dice game in which a player may win at one or more levels without playing for or winning the jackpot.

It is an object of the present invention to provide a dice game with enhanced enjoyment for the user by affording a multiple level/tier game, in which the payout increases as a player progresses to upper levels.

It is a corollary object of the present invention to provide a dice game that is easily understood by the user.

It is a further object of the present invention to provide a dice game which is enjoyable to the player, and that affords an added incentive to a player to continue playing after each winning roll by increasing the odds at each higher tier and requiring the player to place a wager at a next higher level after a win.

A gaming apparatus and method are provided which relate to a dice table game having at least two levels of wagering in cooperation with an optional jackpot wager. During operation, a player places an optional jackpot wager and a first level wager upon one of the possible dice combinations. If the player loses at the first level, both wagers are taken by the house. If the player wins at the first level, the player's jackpot wager remains and the player is paid for the first level wager based upon the odds associated with the selected dice combination. When the player wins at the first level, the player is required to place a wager upon a second level by selecting one of the possible combinations of dice offered at the second level. If the player loses at the second level, the second level wager and the jackpot wager are taken by the house. When the player wins at the second level, a payout is effected based upon the odds associated with the dice combination selected by the player and the jackpot wager is held. After a win at the second level, the player is again required to place a wager at a third level. The third level corresponds to a single dice combination, such as "2". If the third level dice combination is rolled, the player is paid according to a third level payout. In addition, if the player made the appropriate jackpot wager prior to wagering at the first level, the player is also paid from a jackpot.

BRIEF DESCRIPTION OF THE DRAWINGS

The objects and features of the invention noted above are explained in more detail with reference to the drawings, in which like reference numerals denote like elements, and in which.

DETAILED DESCRIPTION OF THE INVENTION

Figure 1:
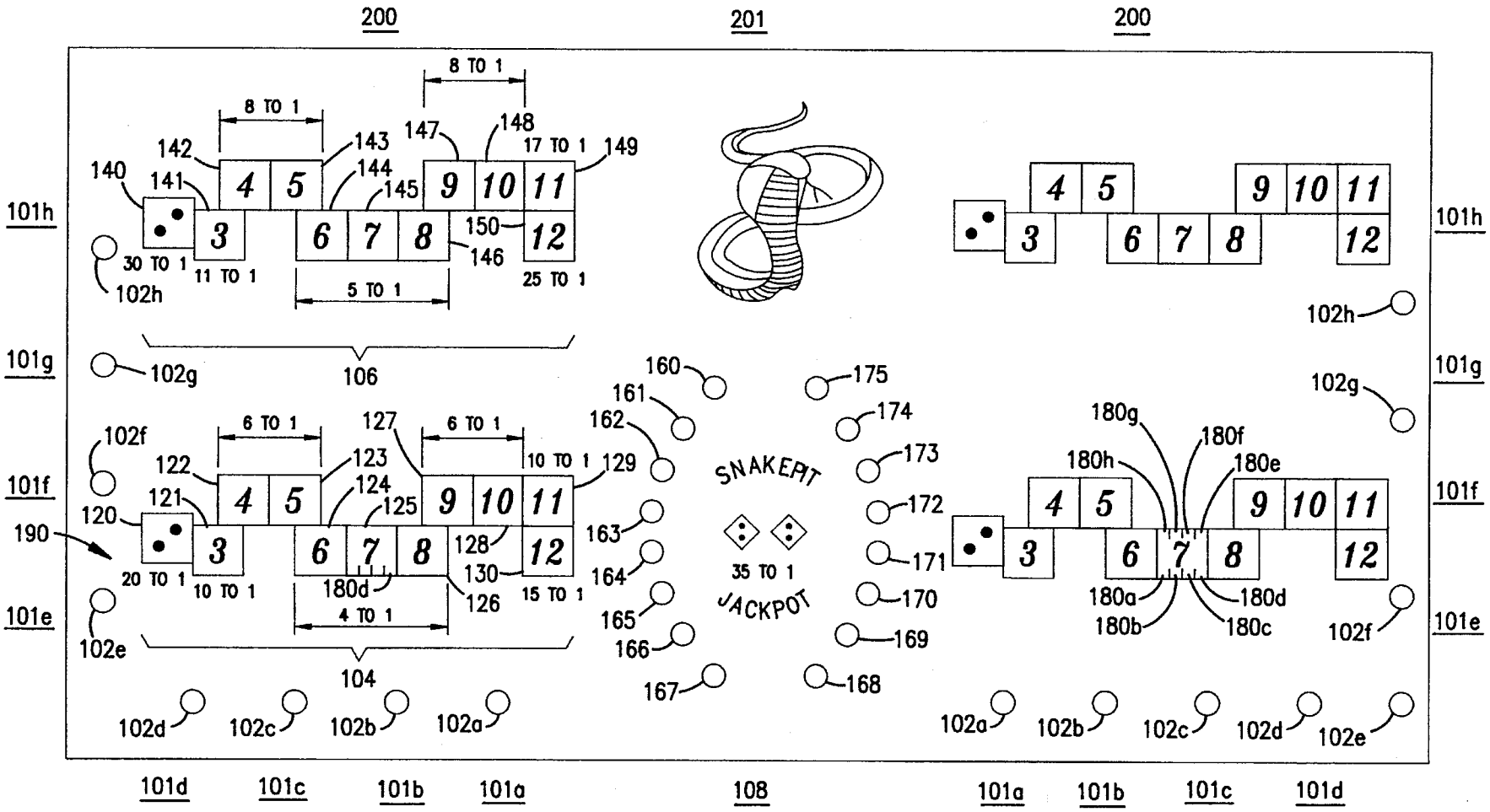
FIG. 1 generally illustrates a top plan view of a casino dice table according to the present invention.

FIG. 1 generally illustrates a table 100 containing a layout for the present game. Opposite sides of the table 100 are identical, and thus only one side is explained hereafter. The table contains multiple player locations 101*a*–101*h* about its perimeter, at which players stand while playing. Multiple jackpot wagering sites 102*a*–102*h* are located upon the table, with each site being adjacent a corresponding player location 101*a*–101*h*. The player places a wager on the jackpot wagering site when the player wishes to place a side bet on the jackpot. The table 100 further includes three wagering levels including a first level 104, a second level 106, and a third level 108.

During operation, a player must successfully wager upon the first level 104 before the player is afforded the opportunity to play at the second level 106. Similarly, the player must successfully wager on the second level 106 before being afforded the opportunity to place a wager at the third level 108. When a player places a winning wager upon the first or second level 104 and 106, the player is required to place a minimum bet at the second or third level 106 and 108. In this manner, play progresses through the three tier structure.

The slot 110 corresponds to an opening in the table, through which the dealer or supervisor inserts money when exchanging such money for chips. Locations 200, 201, and 202 correspond to dealer locations (the person controlling the chips and bets), supervisor locations, and stick person locations (the person controlling the dice), respectively.

The first level 104 includes 11 possible wager options 120–130. Each wagering option 120–130 corresponds to a unique sum resulting from a roll of the dice (i.e., 2–12). When the player initiates play, he/she places a wager on the desired wagering option 120–130, for which the player expects the roll to equal. Indicia 190 are located proximate each option 120–130 identifying the odds associated therewith. These odds direct the amount of a payout. Each wagering option 120–130 is, optionally, subdivided into bet positions 180*a*–180*h* (see "7" in the first level on the right side of the table). Each bet position 180*a*–180*h* corresponds to a player location 101*a*–101*h* and a jackpot wager site 102*a*–102*h*. The bet positions 180*a*–180*h* are optional, but are provided in the preferred embodiment to enable the dealer to keep track of each player's wager by placing such wager in the betting position corresponding to the player location.

The second level 106 includes wagering options 140–150, each of which corresponds to a possible outcome of a roll of the dice. As at the first level, the player places a wager on the option 140–150, for which he/she expects the roll to equal. Each of the betting options 140–150 may optionally be subdivided (while not shown) into a plurality of bet positions, with each wagering option including a separate bet position for each player location. The third level 108 includes a plurality of betting locations 160–175 at least equal in number to the player locations 101*a*–101*h* on the table 100.

Hereafter, the operation of the present invention is explained in detail. The present game is designed for the house to act as the banker and collect all losing wagers and payout all winning wagers. The dealers may be employees of the house, while the players play against the house.

The house chips are stacked in front of the supervisor 203 with each dealer having a working stack of house chips 204 to pay the players. When a player loses his wager to the house, the chips won by the house are stored in the working stack 202 or in front of the supervisor 203. When a player wins, the player is paid from the chips stored by the dealer or by the supervisor. Standard casino-playing dice may be used, with the color being chosen by the house (e.g., white, black, red). The game is played with two dice.

Play initiates when a player places a bet on the first level 104. At this time, the player is also given the opportunity to place an optional wager in the corresponding jackpot wagering site 102, thereby giving the player a chance to win a portion of the jackpot if the player progresses to and wins at the third level 108. Once each player places a wager at the first level 104, the dealer moves this bet to the corresponding bet position 180 within the appropriate wagering option 120–130. For instance, if the player is standing at location 101*d* and wishes to participate in the jackpot and to bet that the resulting combination of dice will equal "7", the player places the jackpot bet on the wagering site 102*d* and the dealer places the first level wager within betting option 125 at betting location 180*d* (corresponding to player location 102*d*). Thereafter, the dice are thrown to obtain a result. If the result equals "7", the player wins, otherwise the player loses. If the player loses, the dealer takes the bet within option 125 and the bet at the jackpot wagering site 102*d*. If the player is a winner, the player is paid winnings according to the size of the wager and the odds 190 corresponding to the winning option 120–130. Thus, if the player makes a ten-dollar wager and correctly bets upon a dice combination of "7", the player is paid forty dollars, since the house pays 4:1 on a "7" result.

If the player places a winning wager on the first level 104, the player is required to place a minimum wager on the second level. Optionally, the player may be given the opportunity to place an increased wager on the second level 106. In the preferred embodiment, when the player wins on the first level 104, the player must place a bet on the second level 106 equal or double the wager on the first level 104. When the player wins on the second level 106, the player must place a wager on the third jackpot level 108 equal to that on the second level 106. When a player places a wager on the second level 106, the above process is repeated as explained in connection with the first level. If the player predicts the winning roll and bets on the correct option 140–150, the player wins on the second level 106. Otherwise, the player loses and the house collects the bet from the second level 106 and the jackpot wager from the jackpot wagering site 102. If the player wins at the second level, a payout is effected in accordance with the odds associated with the winning result. Thereafter, the player is required to move to the third level 108 by placing a bet upon one of the betting locations 160–174. The third level represents the final level, where the player has the ability to win a payout according to the odds (35l1) and a portion of the jackpot. The player wins the jackpot if the dice are rolled to a predefined combination, such as the number 2 and the player placed a jackpot wager before playing at the first level 104. At the third level, the player loses if the dice result in any other combination. If the player loses at the third level, the player must start over at the first level. If more than one player wins the jackpot, they split the payout.

When playing at the first or second level, the player may place money on one or more betting options. A player is only allowed to wager on one level at a time. Thus, if the player has a current bet on the second level, the player may not also initiate a new bet on the first level. When a player moves between levels, the player may be afforded the option of increasing or decreasing the wager.

During operation, after the dice are thrown, the resulting number is marked by the dealer with a marker (also referred to as the puck). The marker is used to show the players, dealer, and surveillance equipment, the winning number, the winning players, and which players are allowed to move to the next level. The players who wagered on the winning number at the first level are paid (depending upon the amount wagered and the odds corresponding to the winning roll). All bets on the remaining numbers lose. If the person throwing the dice (shooter) doesn't win, the dice are passed to the next shooter. If the shooter wins at the first level, his/her bet is moved to the second level. Any other player who bets on the number that the shooter rolls also is paid and moved to the second level. The players who are moved to the second level cannot place a new wager on the first level. Players who bet on the first level and lose also lose the jackpot bet if placed. Losing players may start over at the first level. To do so, the player must also place a new jackpot wager on the jackpot wagering site **102*a*–102*h*** if the player wishes to participate in the jackpot when given the chance. When a player wins on the first level, the player is allowed to place the same wager on the second level or place a double wager on the second level. The player may not bet less on the second level than he/she bet on the first level (in the preferred embodiment). For example, if a person bets five dollars on the first level and wins, the player may bet five or ten dollars on the second level. Once all the bets are placed at the first and second levels, the shooter throws the dice. Thereafter, the winning number is marked by the dealer at both levels and the dealer pays the winners and collects from the losers. If the winners are required to move to the next level, the dealer also moves the necessary minimum bet to the next higher level for each winner.

Winners at the second level who move to the third level must bet the exact amount wagered at the second level. These players are not given the opportunity to increase the bet at the third level. The odds associated with the third level are set by the house and may be fixed at all times (such as 35:1). Optionally, the house may vary the jackpot depending upon how much time has progressed since the previous jackpot payout or upon the number of bets which have been placed since the previous jackpot.

Optionally, each bet must be placed in a predefined increment, such as in five-dollar increments. The dice are passed to the next shooter when the current shooter doesn't have a bet on the winning number. If the shooter wins at all three levels he/she still has the option of continuing to shoot, and thus may remain the shooter for a substantial period of time. A player does not have to throw the dice to win. The player can pass the dice at any time during the game. The dice may be passed to a person who is wagering at any of the three levels. The game is continuous and only stops when all players have left the game or at the manager's discretion. The odds and amounts possible to be bet at each level and the recommended odds may be set by the house. If multiple players win the jackpot, the total is split among the winners.

During operation, the players give their bets to the dealer who places it at the appropriate location chosen by the player. When the dice are rolled, the dealer places a marker on the winning number within the first and second levels. Thereafter, the dealer takes all of the losing bets off the first, second, and third levels and off the jackpot betting sites **102*a*–102*h***. Next, the dealer determines who won on the second level and pays the winners on the second level according to the odds associated with the winning number. Next, the dealer moves the winning bets from the second level for the winners to the third level. Next, the dealer repeats the above steps with respect to the first level and moves the necessary minimum bet for the winners on the first level to the desired location on the second level. Thereafter, the dealer asks for new betters for the first level and play is repeated.

Optionally, the table 100 may be mounted upon the top of a conventional "craps" table (not shown) located within a casino. While the preferred embodiment illustrates eight player locations, this number may be varied as desired.

Optionally, any number of dice may be used so long as the number of wagering options 120–130 at each level is changed accordingly to include one option for each possible result. For instance, if three dice are used, wagering options would be provided for results 2–18.

Optionally, the third level may include more than one wagering option, and the player may be afforded the choice between these wagering options as at the first and second levels. Hence, a payout for the third level would not merely be effected when a single preset roll results. Instead, different players on the third level would win depending upon the option wagered. Each option may include different odds. Also, the jackpot at the third level may be paid out for a dice combination differing from the player's option wagered on the third level.

As a further option, the player may be allowed to place a bet in the jackpot wager, even after progressing beyond the first level. In this instance, the player may place a bet on the first level and no bet in the jackpot participation wagering site. If the player wins on the first level, he/she optionally may then be afforded the ability to move to the second level and add a jackpot participation bet. In this case, it may be preferable to require a larger (double) jackpot wager or require the player to play for a smaller portion or separate jackpot.

Finally, the foregoing system may be implemented electronically upon an electronic casino game at which the player places money into the video machine to play.

From the foregoing it will be seen that this invention is one well adapted to attain all ends and objects hereinabove set forth together with the other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative, and not in a limiting sense.

What is claimed is:

1. A method for playing a progressive wagering game having a plurality of possible results, said game utilizing a board having a hierarchial level structure containing at least a lower level having lower payout odds and containing a next upper level having higher payout odds, wherein said next upper level includes at least one wagering option corresponding to a possible result, and wherein said lower level includes at least two wagering options, each of which corresponds to a possible result, said method comprising the steps of:

placing a base wager on a selected wagering option on said lower level;

obtaining a first result by rolling a set of dice;

when said first result corresponds to said selected wagering option on said lower level, paying the player based on said lower payout odds and moving at least said base wager to a selected wagering option on said next upper level;

obtaining a next result by re-rolling all of said dice in said set of dice; and when said next result corresponds to said selected wagering option on said next upper level, paying a payout based on said higher payout odds.

2. A method for playing a progressive wagering game according to claim 1, further comprising the step of:

preventing the player from placing a wager on said next upper level, until the player places a winning wager on a lower level.

3. A method for playing a progressive game according to claim 1, wherein said next upper level represents a second level and said next result represents a second result, said method further comprising the steps of:

providing a third level above said second level having a plurality of wagering options, each corresponding to a possible result;

placing a wager on a selected wagering option on said third level, only when said selected wagering option on said second level corresponds to said second result;

obtaining a third result; and when said third result corresponds to the selected wagering option on said third level, paying a winning player.

4. A method for playing a progressive wagering game, according to claim 1, wherein a player is only allowed to wager upon one of the levels at any given time.

5. A method for playing a progressive wagering game, according to claim 1, further comprising the step of:

playing for a jackpot when the player reaches said next upper level provided a jackpot participation wager has been placed prior to obtaining said next result.

6. A method for playing a progressive wagering game, according to claim 1, wherein said lower and higher payout odds differ.

7. A method for playing a progressive wagering game, according to claim 1, further comprising the steps of:

providing a jackpot as a side bet and a plurality of jackpot wagering sites equal to a number of possible player locations;

placing a wager at said jackpot wagering site to participate in a jackpot wager; and paying said jackpot to a winner at said next upper level provided said winner has previously placed a wager at the jackpot wagering site.

8. A method of playing a progressive wagering game, according to claim 7, further comprising the step of:

allowing a wager to be placed at said jackpot site only before obtaining said first result and not thereafter.

9. A method for playing a progressive wagering game, according to claim 1, further comprising the steps of:

providing a jackpot wager as a side bet in addition to a wager placed on said next upper level; and paying a jackpot payout in addition to a next upper level payout after a win at said next upper level.

10. A method of playing a progressive game, comprising the steps of:

providing a multi-tiered game structure having a lowest tier and a highest tier, at least one of said tiers having a plurality of wagering options, each option of which corresponds to a different game result;

selecting at least one of said wagering options at a current tier, beginning with said lowest tier;

obtaining a game result;

repeating said selecting and obtaining steps at a next higher tier when the game result corresponds to a selected wagering option; and permitting a wagering option to be selected on said highest tier only after previously winning on at least one lower tier.

11. A method according to claim 10, further comprising the step of wagering at the highest tier only after progressively winning at each lower tier.

12. A method according to claim 10, further comprising the steps of:

providing a side bet participation wagering option at which a user places a wager to play for a side bet; and requiring a wager to be placed at the side bet participation wagering option prior to obtaining said game result when wagering at the lowest tier if the player desires to play for said side bet.

13. A method according to claim 10, further comprising the step of:

providing at least lowest, intermediate, and highest tiers, said lowest and intermediate tiers each having an equal plurality of wagering options corresponding to a number of possible game results, wherein said selecting and obtaining steps are repeated at said intermediate tier only after winning at said lowest tier.

14. A method according to claim 10, further comprising the step of requiring the player to place a wager at each progressively higher tier after winning at a preceding lower tier.

15. A method for playing a progressive wagering game having a plurality of possible results, said game containing at least first and second levels including wagering options corresponding to possible results, said method comprising the steps of:

placing a base wager of a first player on a selected wagering option on said first level;

obtaining a first result;

when said first result corresponds to said selected wagering option on said first level, paying said first player and placing at least said base wager of said first player on a selected wagering option on said second level;

after placing said base wager of said first player on said selected wagering option on said second level, placing a base wager of a second player on a selected wagering option on said first level;

obtaining a second result; and when said second result corresponds to one of said selected wagering options on said first and second levels, paying a corresponding one of said first and second players.

16. A method for playing a progressive game according to claim 15, further comprising the step of:

preventing all players from placing a base wager on said second level until after placing said base wager on said selected wagering option on said first level corresponding to said first result.

* * * * *